US005970896A

United States Patent [19]

Zinssmeister et al.

[11] Patent Number: 5,970,896

[45] Date of Patent: Oct. 26, 1999

[54] PROCESS AND SEWING UNIT FOR SEWING A FLAP AND A POCKET ON A FABRIC PART

[75] Inventors: Axel Zinssmeister, Rothselberg; Werner Schlaefer, Krickenbach, both of Germany

[73] Assignee: G.M. Pfaff Aktiengesellschaft, Kaiserlautern, Germany

[21] Appl. No.: 09/215,015

[22] Filed: Dec. 17, 1998

[30] Foreign Application Priority Data

Dec. 18, 1997 [DE] Germany ..... 197 56 350
Nov. 26, 1998 [DE] Germany ..... 198 54 688

[51] Int. Cl.[6] ..... D05B 21/00; D05B 35/06

[52] U.S. Cl. ..... 112/470.16; 112/475.06; 112/475.09

[58] Field of Search ..... 112/475.06, 475.09, 112/470.16, 114, 147, 141, 104, 148; 223/37, 38

[56] References Cited

U.S. PATENT DOCUMENTS 5,133,271 7/1992 Iwasaki et al. ..... 112/114
5,454,336 10/1995 Iwasaki ..... 112/470.16

FOREIGN PATENT DOCUMENTS 41 13 131 C1 7/1992 Germany .
41 24 164 C2 6/1993 Germany .
42 34 968 C1 12/1993 Germany .
197 05 314 A1 9/1998 Germany .
197 15 340 A1 10/1998 Germany .

OTHER PUBLICATIONS

Pfaff, Mar. 1983, "*Pfaff Special Service 310–01*", Pfaff Information Brochure.

*Primary Examiner*—Peter Nerbun
*Attorney, Agent, or Firm*—McGlew and Tuttle, P.C.

[57] ABSTRACT

To sew presewn flaps (P) on a fabric part (W), the flap (P) is positioned in its later position of use in a movable fabric holder of a sewing unit, and it partially overlaps a pocket (T) to be sewn on the fabric part (W). After the workpiece parts (W, P, T) have been fed to the sewing machine, the flap (P) is first connected to the fabric part (W) by a seam (N1). The part of the flap (P) overlapping the pocket (T) is then folded over and the pocket (T) is then connected by a seam (N2) to the fabric part (W).

16 Claims, 7 Drawing Sheets

54
55
56
40
42
41
35
36
57
52
48
50
46
51
45
47
44
P
53
43
33
VIII
T
34
39
31
32
7
30

41
38
42
35
36
37
51
46
48
50
39
43
30
31
32
W
33
T
49
58
P
1

53
44
39
32
34
T
W
P
1

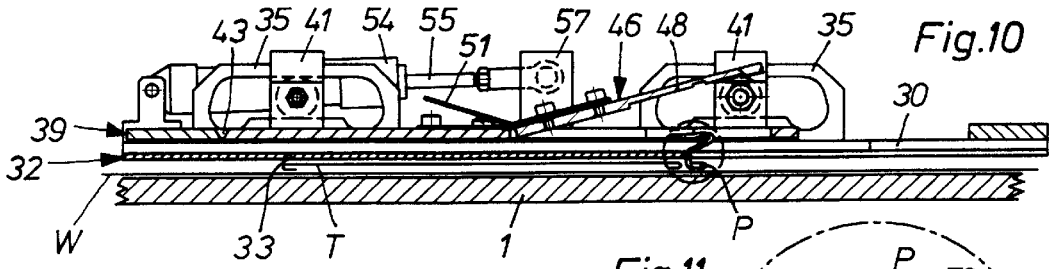
Fig.10
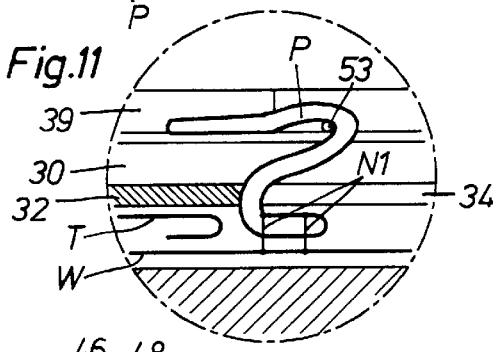
Fig.11
Fig.12
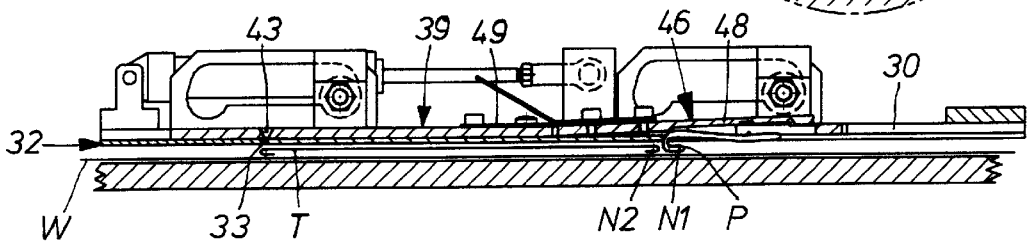
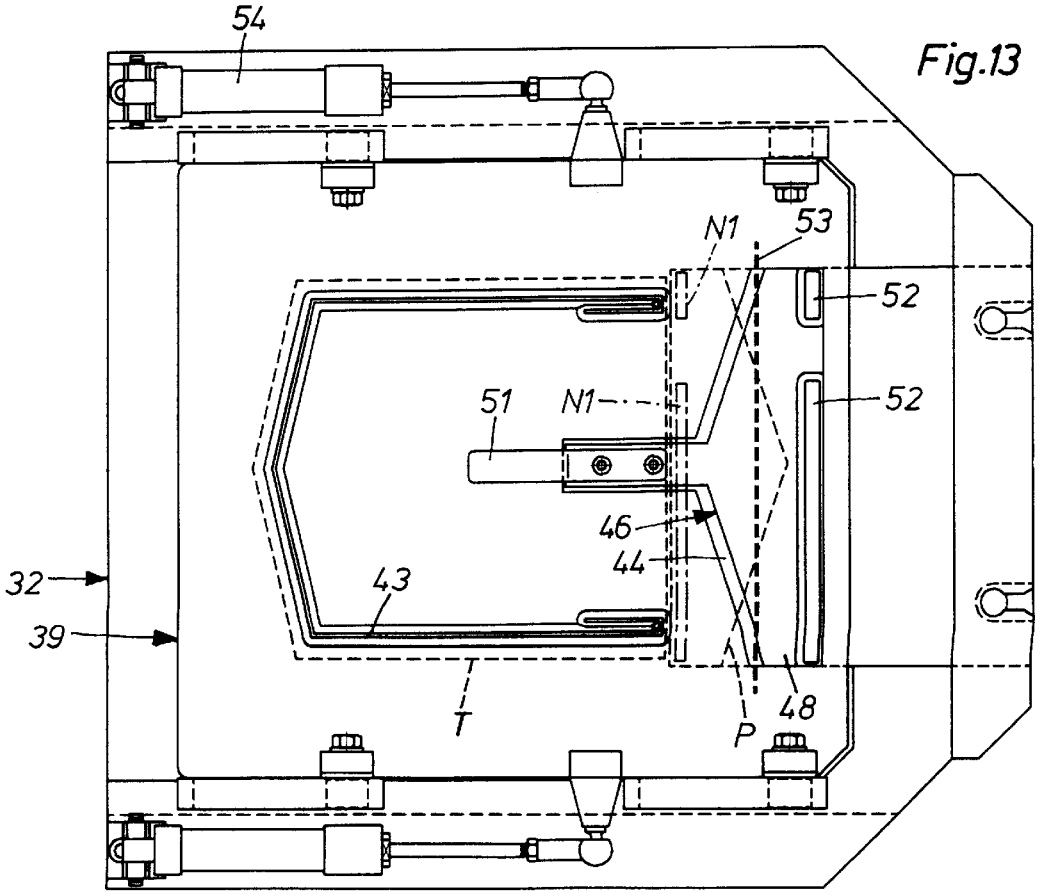
Fig.13

PROCESS AND SEWING UNIT FOR SEWING A FLAP AND A POCKET ON A FABRIC PART

FIELD OF THE INVENTION

The present invention pertains to a process for sewing on finished flaps and to a process for sewing unfinished flaps with a pocket on a fabric part using a sewing unit with a sewing machine and with a guide means having a fabric holder.

BACKGROUND OF THE INVENTION

The difference between finished flaps and unfinished flaps has been known to be that finished flaps contain a folded closing edge, while unfinished flaps have an unfolded, open and consequently unfinished closing edge tending to fray. This difference also requires different sewing-on processes. Thus, finished flaps are always sewn on the fabric part, which may be a shirt part, a pants part or a jacket or coat part, in an aligned position that always corresponds to the later position of use. In contrast, unfinished flaps are first positioned in an aligned position that is rotated by 180° relative to the later position of use, then fastened to the fabric part with a first seam located close to the unfinished closing edge, then they are folded over this seam into the position of use, and finally sewn on the fabric part with a second seam. The process for sewing on unfinished flaps has been known from, e.g., the PFAFF information brochure "PFAFF Special Service 310-01," printed March 1983.

A process for sewing a finished flap and a pocket on a fabric part, in which the flap is positioned on the fabric part in relation to the pocket such that it first assumes a non-overlapping position, has been known from DE 41 24 164 C2. These three workpiece parts are grasped by a fabric holder and fed together to the sewing machine by means of a support plate of the sewing unit. Then, the pocket is first sewn on the fabric part. The fabric part with the sewn-on pocket is then fixed on the support plate by means of an additional, stationary holding means operated with suction air. The flap is fixed during this time at a flap-clamping plate either by a suction air holding means or by means of a mechanically acting gripping holding means, the entire fabric holder together with the flap-clamping plate and the flap-holding means is pushed off from the fabric part and the pocket and then displaced horizontally to the extent that the flap will overlap the pocket in the desired manner. After the fabric holder has been again lowered onto the fabric part and the pocket, the flap is sewn on the fabric part in its position of use.

Due to the measure of transferring the flap from a first into a second position after sewing on the pocket, the normal holding function of the fabric holder, i.e., the clamping function in cooperation with the support plate, must be eliminated during this process step. Since the holding function for the workpiece parts to be displaced in relation to one another must be assumed, instead, by two additional holding means, the means for carrying out this process are comparatively complicated. Furthermore, there is a risk that the relative position of the flap in relation to the pocket or to the position of the programmed flap seam to be sewn subsequently will be displaced during the transition of the holding function from the fabric holder to the two additional holding means and vice versa. Since the flap seam is located at a short distance from the upper edge of the flap only, such a displacement or even a rotation by a certain angle would lead to a sewing result of an unattractive appearance.

A process and a sewing unit for sewing on an unfinished flap, in which process and sewing unit the flap is placed on a fabric holder in a position rotated by 180° in relation to the later position of use, have been known from DE 197 05 314 A1. The fabric holder takes over the folded pocket in the known manner and feeds the fabric part, the pocket and the flap to the sewing machine, where the pocket is sewn on first. The fabric holder is subsequently moved to a stationary holding means (98), which holds the fabric part together with the sewn-on pocket and the still loose flap on the support plate by means of suction air. The fabric holder is raised during this time and is displaced in the horizontal direction from the pocket sew-on position into the flap sew-on position. A holding strip (80) comes to lie on the edge of the flap in the vicinity of the seam to be prepared first during the lowering of the fabric holder and it subsequently holds same. As soon as the first flap seam has been formed, the flap is folded around the seam or the holding strip (80) into its position of use by means of a turning strip (66) and is held in this position, after which the second flap seam is formed.

Another sewing unit, which is used to sew on unfinished flaps, has been known from DE 197 15 340 A1. For the functions of holding and folding over the flap, this sewing unit has a total of three components arranged on a fabric holder (40), namely, a flap clamp (53), a holding strip (77), and a turning strip (74) called a clamp turner. The process of sewing on the flap is essentially the same as in the sewing unit according to the above-mentioned DE 197 05 314 A1, but with the difference that during folding over into the position of use, the flap is folded around the first flap seam as in the case of the process carried out manually according to the above-mentioned PFAFF brochure, rather than around the holding strip. After sewing on the pocket, the fabric holder is moved to a stationary holding means (93) in this sewing unit as well, and the holding means (93) will then hold the fabric part together with the sewn-on pocket on the support plate of the sewing unit by suction air. The fabric holder is then lifted off from the fabric part and the pocket and is displaced by a predetermined path in the horizontal direction and is then again placed on the fabric part and the pocket, after which the flap is now in its correct position in relation to the pocket.

Thus, the two prior-art sewing units for sewing on an unfinished flap have one essential feature in common, namely, that the normal holding function of the fabric holder, i.e., the clamping function in cooperation with the support plate, is eliminated after sewing on the pocket, in order to be able to displace the fabric holder at least in relation to the fabric part and the sewn-on pocket. Therefore, there is also a feature in common with the sewing unit known from DE 41 24 164 C2 for sewing on finished flaps, i.e., the two sewing units for sewing on unfinished flaps have the same basic drawbacks, namely, the complicated means, on the one hand, and, on the other hand, the risk that the relative position of the flap in relation to the sewn-on pocket may be displaced.

SUMMARY AND OBJECTS OF THE INVENTION

The primary object of the present invention is to provide a process for sewing on finished flaps and a process for sewing unfinished flaps on a fabric part and a sewing unit each for carrying out these processes, in which undesired relative displacements between the flap, the pocket and the fabric part are avoided with certainty.

According to the invention, a process is provided for sewing a finished (presewn flap) and a pocket partially covered by the flap on a fabric part by using a sewing unit, with a sewing machine and a guide means having a fabric holder. The process includes folding the pocket over in the edge area and grasping the folded pocket and the fabric part by the fabric holder in cooperation with a fabric support plate in a frictionally engaged manner. The frictional engagement is maintained uninterruptedly during the subsequent operations. The flap is positioned in the fabric holder in its later position of use. The fabric part the pocket and the flap are fed by the guide means to the sewing machine. The flap is connected to the fabric part by a seam. The part of the said flap overlapping the said pocket is removed from the area of the said pocket. The pocket is connected to the fabric part by another seam.

Due to the measure of positioning the flap immediately in its later position of use in relation to the pocket, due to the flap being sewn on only thereafter and due to the overlapping part of the flap then being removed from the area of the pocket in order for this to be then also able to be sewn on, it is possible for the fabric holder to hold the fabric part and the pocket placed thereon in fixed relative positions in relation to one another during all these process steps. Since the relative position of the flap in relation to the fabric part is held after the flap has been sewn on, there can be no relative displacement in relation to the pocket or the fabric part during the removal of the overlapping part. It is thus guaranteed that both the flap and the pocket are secured against unintended relative movements in relation to one another or to the fabric part during the entire process.

To carry out the process according to the invention, a sewing unit is provided. Since the sewing unit has no holding means for the fabric part and the pocket that would act alternatingly with the fabric holder, and also has no additional holding means for the flap, the effort in terms of device for carrying out the process is far lower than in the case of the sewing unit according to DE 41 24 164 C2.

An especially simple variant of the sewing unit is also described. An alternative embodiment is also described that differs from the first one in that the holding plate for the pocket is designed as an especially flat holding plate and that a carrier plate that is displaceable relative to the support plate is arranged above the support plate for the flap-pressing plate and for the flap-folding element. Due to the smaller thickness of the holding plate, there will be a greater difference in height between the edge area of the flap to be sewn on and the other part of the flap lying on the holding plate than in the case of the especially simple variant of the sewing unit. The smaller difference in height causes the flap to be deflected only slightly in the edge area to be sewn on, which is especially advantageous in the case of a stiffer flap material.

Further process features are described according to which the holding action of the fabric holder with respect to the fabric part and the pocket placed thereon is maintained uninterruptedly during the entire duration of the work cycle, i.e., until the second flap seam is formed, it is thus guaranteed, in the same manner as in the process discussed above, that both the flap and the pocket are secured against unintended movements in relation to one another or to the fabric part during the entire process.

Similar statements can also be made concerning the sewing units described for carrying out the process. Since they also lack a holding means for the fabric part and the pocket acting alternatingly with the fabric holder, the means necessary for carrying out the process are far less complicated than in the case of the sewing units according to DE 197 05 314 A1 and DE 197 15 340 A1.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 10 is a sectional view corresponding to FIG. 8, wherein the situation is shown in which the part of the flap overlapping the pocket is partially folded over after the flap has been sewn on;

FIG. 11 is an enlarged detail from FIG. 10;

FIG. 12 is a sectional view corresponding to FIG. 8 after sewing on the flap;

FIG. 13 is a top view of the fabric holder of the second exemplary embodiment before sewing on the pocket.

DESCRIPTION OF THE PREFERRED EMBODIMENTS

Figure 1:
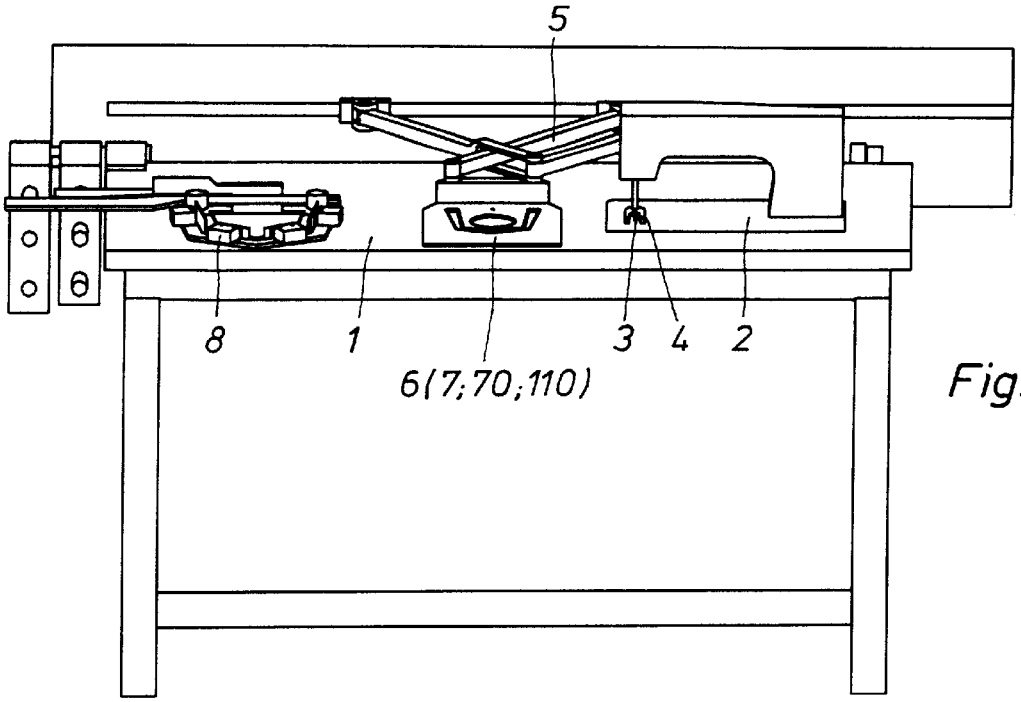
FIG. 1 is a front view of a sewing unit.
Figure 2:
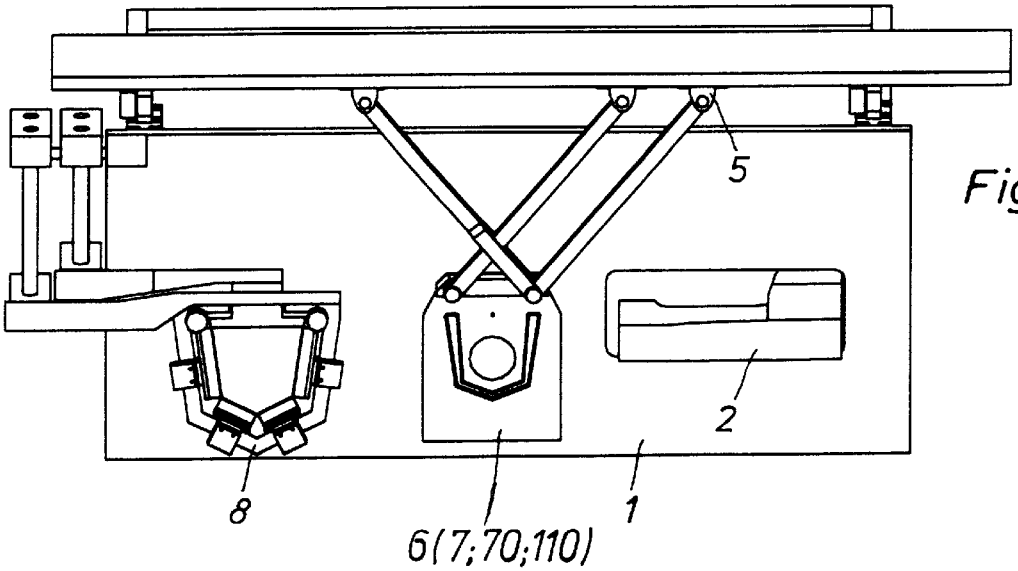
FIG. 2 is a top view of the sewing unit.
Figure 3:
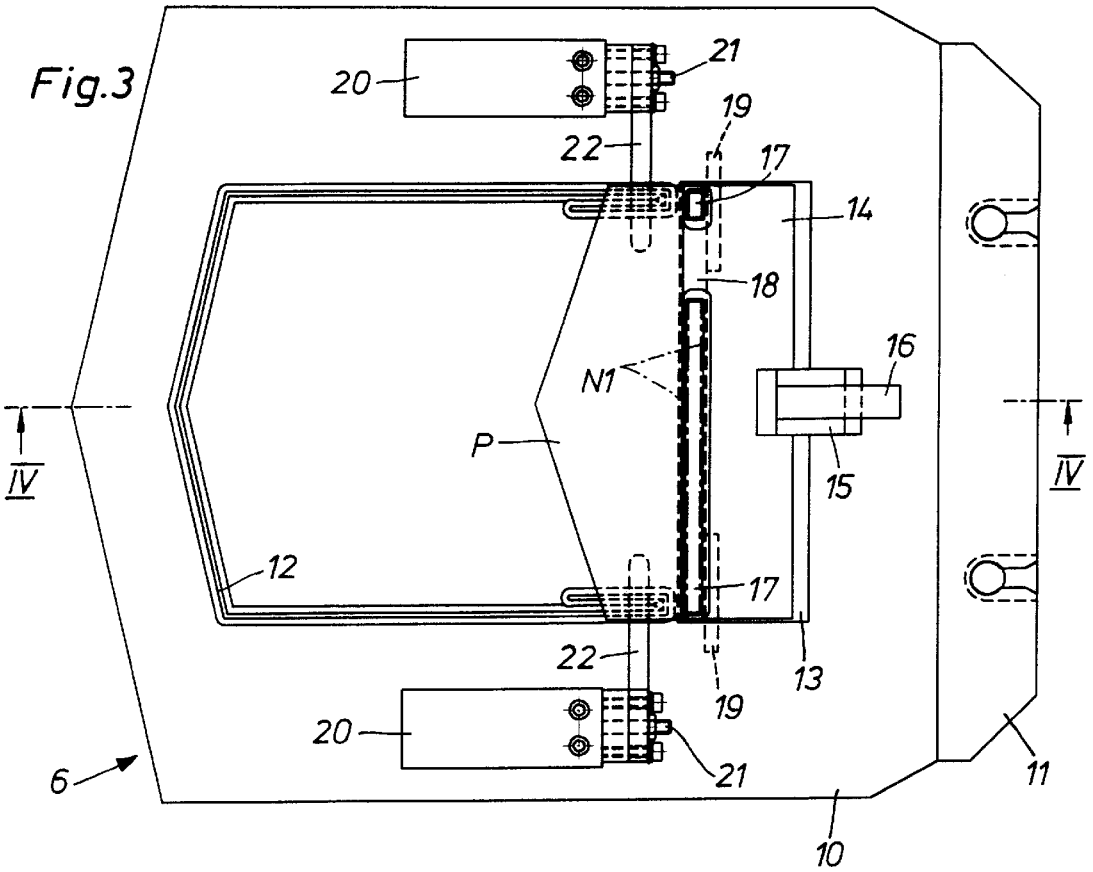
FIG. 3 is a top view of the fabric holder of the first exemplary embodiment after sewing on a finished flap.
Figure 4:
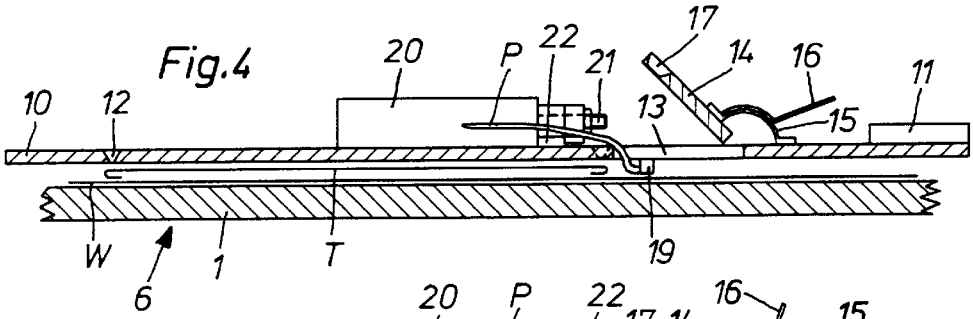
FIG. 4 is a sectional view of the fabric holder along line IV—IV in FIG. 3 with the pressing plate for the flap opened and with the flap inserted.
Figure 5:
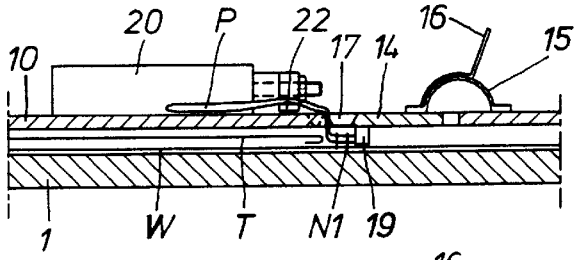
FIG. 5 is a sectional view corresponding to FIG. 4 after sewing on the flap.
Figure 6:
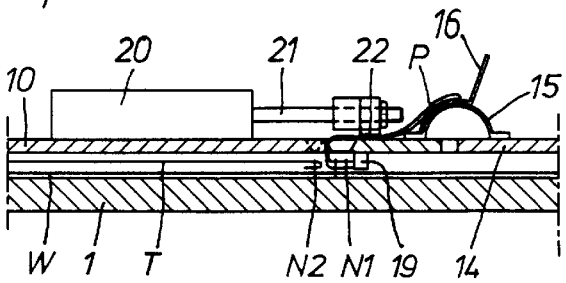
FIG. 6 is a sectional view corresponding to FIG. 4 after sewing on the pocket.
Figure 7:
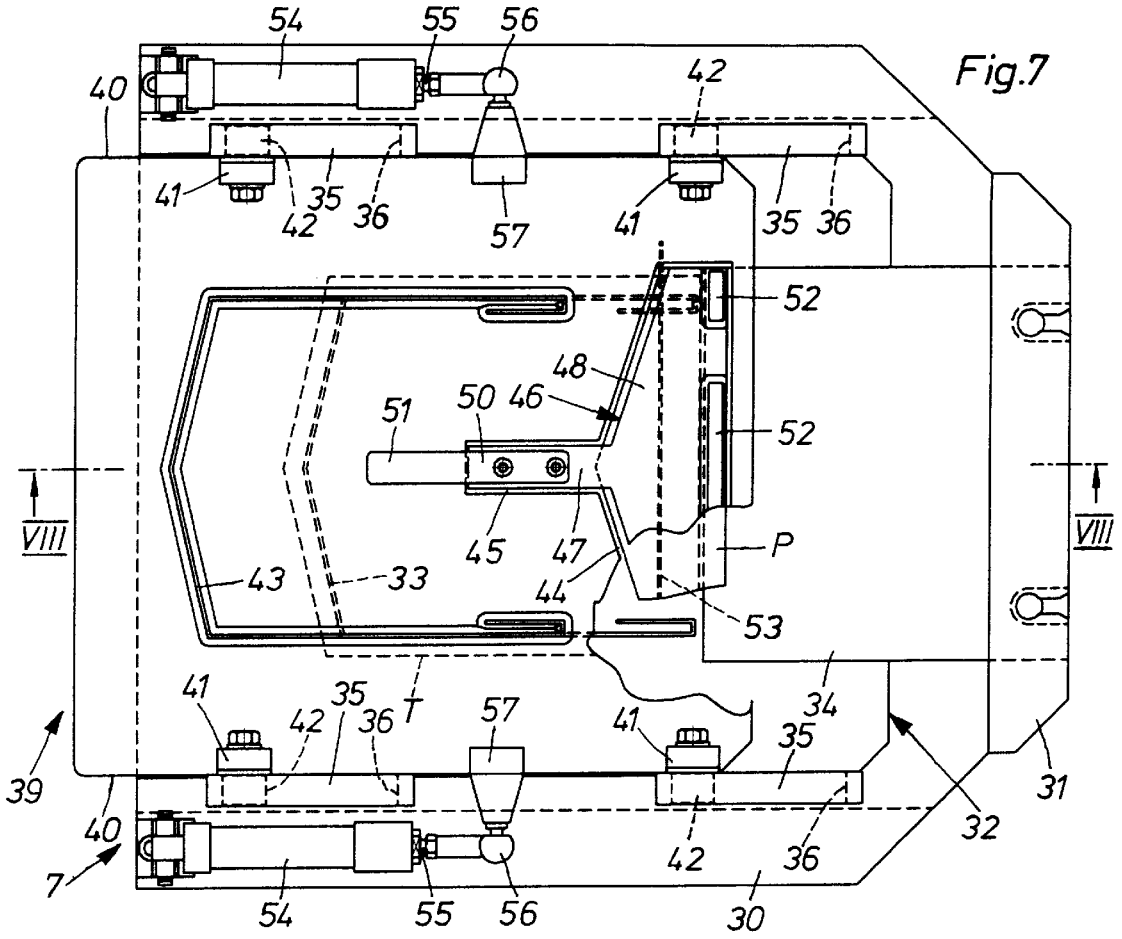
FIG. 7 is a top view of the fabric holder of the second exemplary embodiment after inserting a finished flap with the pressing plate for the flap closed.

The sewing unit shown in FIGS. 1 and 2, which is used to sew flaps P and pocket T on a fabric part W, corresponds to the sewing unit described in DE 42 34 968 C1. Therefore, it also has a fabric support plate 1, a sewing machine 2 with a driven needle 3, and a holding-down device 4 that can be moved up and down, as well as a guide means 5 for a fabric holder 6, 7, 70 or 110. A folding device 8, which is used to fold over the edge sections of the pockets T and belongs to the state of the art and is known from, e.g., DE 41 13 131 C1, is also associated with the sewing unit.

The guide means 5 is designed in the known manner such that it can move the fabric holder 6 or 7 up and down at right angles to the surface of the support plate 1. Furthermore, it is used to move the fabric holder 6, 7, 70 or 110 to and fro between the folding device 8 and the sewing machine 2 as well as to perform the relative movement of the fabric holder 6, 7, 70 or 110 in relation to the sewing machine 2, which relative movement is necessary for preparing the flap seams and the pocket seams.

Exemplary Embodiment 1

The fabric holder 6 shown in FIGS. 3 through 6 has a flat holding plate 10 for the fabric part W lying on the support plate 1 and for the pocket T placed thereon. The holding plate 10 can be coupled with the guide means 5 by means of a coupling strip 11.

The holding plate 10 contains a sewing slot 12 for the passage of the needle 3 during the preparation of the essentially U-shaped pocket seam N2. A rectangular recess 13 is provided in the holding plate 10 at a closely spaced location from the sewing slot 12. A pressing plate 14 for the flap P, which pressing plate fits the recess 13, is associated with the said recess 13. The pressing plate 14 is fastened to one end of an arched leaf spring 15, whose other end is fastened to the holding plate 10. The leaf spring 15 is used not only as a carrier for the pressing plate 14, but additionally also as a joint, so that the pressing plate 14 can be pivoted to and fro between a pressing position according to FIGS. 5 and 6 and an open position according to FIG. 4.

The leaf spring 15 is pretensioned such that it holds the pressing plate 14 in the pressing position. A grip 16, which enables the operator to pivot the pressing plate 14 into the open position, is connected to the leaf spring 15.

The pressing plate 14 contains a broad sewing slot 17 for forming a flap seam N1 designed as a double seam. The interruption of the sewing slot 12, which is designated by 18, brings about a corresponding seam interruption for passing through a pencil.

One flat stop strip 19 each is fastened on both sides of the recess 13 on the underside of the holding plate 10. The thickness of the stop strips 19 is shown enlarged in FIGS. 4 through 6 for clarity's sake only. In reality, it must be smaller than the thickness of the folded-over edge areas of the pocket T.

One compressed air cylinder 20 each is arranged on the holding plate 10 on both sides of the sewing slot 12. A flat finger 22 each, which extends beyond the respective leg of the U-shaped sewing slot 12 at right angles to the direction of movement of the piston rods 21 just above the holding plate 10, is fastened to the piston rod 21 of each cylinder 20.

The Mode of Operation is as Follows

The fabric part W is first spread out flat on the support plate beneath the folding device 8 and is aligned by means of markings, not shown. The pocket T is then folded over on three sides in the folding device 8 in a known manner, which is therefore not explained in greater detail, and is then lowered onto the fabric part W according to the pattern. The guide means 5 now moves the fabric holder 6 into the area of the folding device 8 and takes over the fabric part W and the pocket T placed thereon in the process in the known manner. The holding plate 10, which is provided with a sticky coating on its underside, now presses the fabric part W against the smooth, polished surface of the support plate 1.

The operator pivots the pressing plate 14 into its open position with one hand and places the flap P with the edge area to be sewn on into the recess 13 with the other hand, aligning the edge of the flap at the stop strips 19. After releasing the grip 16, the leaf spring 15 pivots the pressing plate 14 back into the pressing position according to FIG. 5, as a result of which the edge area of the flap P located in the recess 13 is pressed against the fabric W. The rest of the flap P now lies loosely on the holding plate 10 and the fingers 22. On the whole, the flap P is already in the position at this point in time that corresponds to the later position of use, in which the flap P partially overlaps the pocket T.

The fabric holder 6 is then transferred by the guide means 5 from the take-over position in the area of the folding device 8 into the sewing position, while the holding plate 10 moves the fabric part W with the pocket T along on the support plate 1. Since the fabric part W and the pocket T are grasped by the holding plate 10 in a frictionally engaged manner, there is now neither relative movement of the two workpiece parts W and T either in relation to the holding plate 10 nor in relation to one another. Furthermore, since the flap P is clamped within the fabric holder 6, its relative position in relation to the pocket T is also secured during the displacing movement of the fabric holder 6 by means of the fingers 22.

With the holding-down device 4 raised, the fabric holder 6 is first moved with the sewing slot 17 into the sewing position. As soon as this position has been reached, the holding-down device 4 is lowered onto the pressing plate 14, as a result of which the latter is pressed even more firmly against the clamped edge area of the flap P. With the holding plate 10 continuing to lie on the fabric part W and on the pocket T, the flap seam N1 is then formed, i.e., the flap P is thus sewn on the fabric part W.

After the flap P has been sewn on, the fabric holder 6 is displaced to the extent that the flap P will be located outside the area of the holding-down device 4. Pressure is then admitted to the compressed air cylinders 20, after which they fold over the part of the flap P that overlaps the pocket T in the direction of the pressing plate 14 according to FIG. 6.

As soon as the sewing slot 12 has become free, the pocket seam N2 is formed, and the pocket T is thus sewn on the fabric part W. During these process steps, the fabric holder 6 remains in its lowered position, in which the holding plate 10 continues to hold the fabric part W and the pocket T in a frictionally engaged manner and prevents any relative movement of the workpiece parts W, T and P in relation to the fabric holder 6 and in relation to one another. It is thus guaranteed that the flap P and the pocket T will be sewn on the fabric part W exactly in the original, mutually aligned positions.

Exemplary Embodiment 2

The fabric holder 7 shown in FIGS. 7 through 13 has an essentially U-shaped frame 30 with a coupling strip 31, by means of which frame the fabric holder 7 can be coupled with the guide means 5.

A plane (level) and especially flat holding plate 32 for the fabric part W and the pocket T placed thereon is fastened to the underside of the frame 30. The holding plate 32 contains a sewing slot 33 for the passage of the needle 3 during the preparation of the essentially U-shaped pocket seam N2. A rectangular recess 34, which extends below the coupling strip 31, is provided in the holding plate 32 at a closely spaced location from the sewing slot 33.

Adjoining the holding plate 32, four small bearing blocks 35 are fastened to the frame 30. One guide groove 36 each, which is composed of a middle part 37 extending in parallel to the holding plate 32 and two obliquely extending end areas 38, is contained in the small bearing blocks 35.

Above the holding plate 32, the fabric holder 7 has a flat carrier plate 39, which on its lateral edges 40 has four small blocks 41 with a freely rotatably roller 42 each projecting over the lateral edge 40. The carrier plate 39 is mounted movably on the frame 30 by means of the rollers 42 engaging the corresponding guide grooves 36 of the small bearing blocks 35.

For forming the pocket seam N2, the carrier plate 39 contains a sewing slot 43, which corresponds to the sewing slot 33 in the holding plate 32. A recess 44, which corresponds essentially to the size and shape of the flaps P to be sewn on, is contained in the carrier plate 39 at a more widely spaced location from the sewing slot 43. A second, much narrower recess 45 in the carrier plate 39, which extends up to and between the legs of the sewing slot 43, opens into the recess 44. An essentially T-shaped plate 46, which fits the two recesses 44, 45 and is composed of a web part 47 and a pressing plate 48 for the flap P to be sewn on, is associated with the two recesses 44, 45. The plate 46 is held by a leaf spring 49, and one half of the leaf spring 49 is fastened to the carrier plate 39 and the other half to the web part 47.

Figure 8:
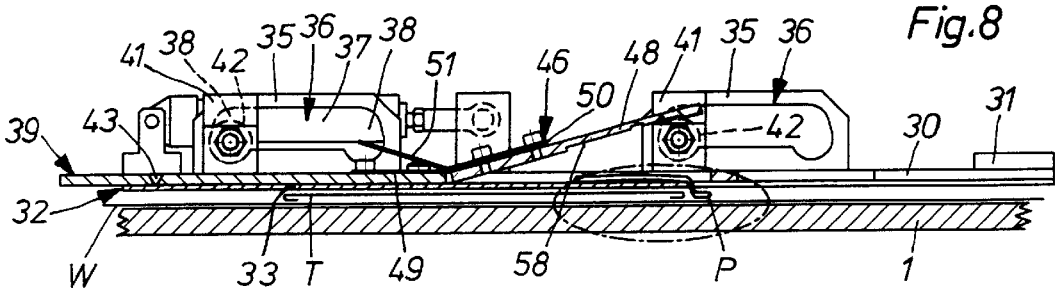
FIG. 8 is a sectional view of the fabric holder along line VIII—VIII in FIG. 7 after insertion of a flap with the pressing plate opened.

The leaf spring 49 is used not only as a support for the plate 46, but additionally also as a joint, so that the plate 46 can be pivoted to and fro between a pressing position according to FIG. 12 and an open position according to FIGS. 8 and 10. The leaf spring 49 is pretensioned such that it holds the plate 46 and the pressing plate 48 in the pressing position. A narrow angle plate 50, which has a grip part 51, is fastened to the leaf spring 49.

The pressing plate 48 contains a broad sewing slot 52 for forming the flap seam N1. The shape and size of this sewing slot 52 correspond exactly to those of the sewing slot 17 of the first exemplary embodiment.

A wire-like folding bar 53, which extends at right angles to the direction of movement of the carrier plate 39 in the lower area of the recess 44, is recessed into and fastened in the underside of the carrier plate 39. One compressed air cylinder 54 each is pivotably mounted on the frame 54 on either side of the carrier plate 39. The piston rods 55 are connected to carrier pieces 57 fastened to the carrier plate 39 via ball-and-socket joints 56.

The Mode of Operation is as Follows

As in the first exemplary embodiment, the fabric part W is spread out flat under the folding device 8 and aligned. As soon as the pocket T has been folded over and placed on the fabric part W, the guide means 5 moves the fabric holder 7 into the area of the folding device 8 and takes over the two workpiece parts W and T. The holding plate 32, which is provided with a sticky coating on its underside, now presses the fabric part W against the support plate 1. No later than at this point in time, the carrier plate 39 is moved by means of the two compressed air cylinders 54 into the position shown in FIGS. 7 and 8, in which the sewing slot 52 for the flap seam N1 is located at the normal, shorter distance from the sewing slot 33 provided in the holding plate 32 for the pocket seam N2, and the sewing slot 43 for the pocket seam N2, which is contained in the carrier plate 39, is offset in relation to the sewing slot 33.

Figure 9:
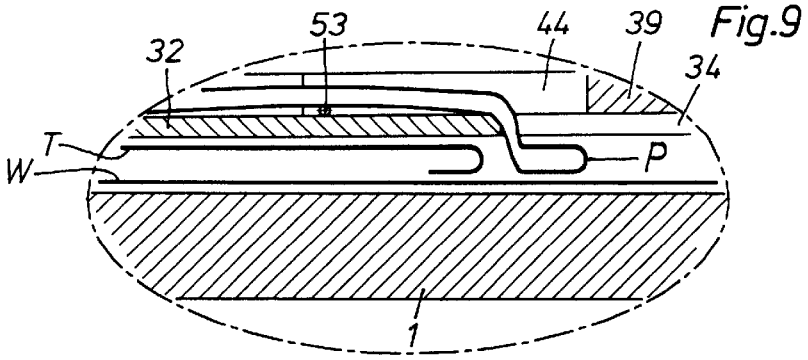
FIG. 9 is an enlarged detail from FIG. 8.

The operator then pivots the plate 46 into its open position with one hand and places the flap P into the recess 44 of the carrier plate 39 with the other hand, most of the flap P lying on the holding plate 32 and, according to FIG. 9, also above the folding bar 53. The flap P is aligned by the operator at the limiting edge of the recess 44, which edge extends at an obtuse angle. The edge area of the flap P to be sewn on projects over the limiting edge of the recess 34 of the holding plate 32 and comes to lie directly on the fabric part W. After releasing the grip 51, the leaf spring 49 pivots the plate 46 and consequently also the pressing plate 48 of that plate 46 back into the pressing position according to FIG. 7, as a result of which the edge area of the flap P to be sewn on is pressed against the fabric part W. The rest of the flap is held down on the holding plate 32 by the pressing plate 48, which has a flat recess 58 (FIG. 8) in this area. The folding bar 53 now continues to be located under this part of the flap P. On the whole, the flap P is already in a position at this point in time that corresponds to the later position of use, in which the flap P partially overlaps the pocket T.

The fabric holder 7 is then transferred by the guide means 5 into the sewing position. Since the fabric part W and the pocket T are now being grasped by the holding plate 32 in a frictionally engaged manner and the flap P is being pressed by the pressing plate 48 against the fabric part W in a skidproof manner, the relative positions of the workpiece parts W, T and P in relation to one another as well as in relation to the fabric holder 7 are secured.

With the holding-down device 4 raised, the fabric holder 7 is first moved with the sewing slot 52 into the sewing position. As soon as this position has been reached, the holding-down device 4 is lowered onto the pressing plate 48, as a result of which the latter is pressed even more firmly against the edge area of the flap P to be sewn on. With the holding plate 32 continuing to lie on the fabric part W and on the pocket T, the flap seam N1 is then formed and the flap P is thus sewn on the fabric part W.

After the flap P has been sewn on, the fabric holder 7 is displaced to the extent that the grip part 51 comes to lie under the raised holding-down device 4. By admitting pressure to the two compressed air cylinders 54, the carrier plate 39 is then displaced from the starting position shown in FIGS. 7 and 8 into the sewing position shown in FIGS. 12 and 13 in relation to the holding plate 32. This displacing movement is facilitated by the rollers 42 being pushed upwards in the left-hand, obliquely extending end area 38 of the guide grooves 36 at the beginning of the displacement, lifting the carrier plate 39 off from the holding plate 32 as a result, as a consequence of which the carrier plate 39 has no contact with the holding plate 32 as long as the rollers 42 are moving within the middle part 37 of the guide grooves 36. The carrier plate 39 is again lowered onto the holding plate 32 only when the rollers 42 enter the right-hand, obliquely extending end area 38 of the guide grooves 36 near the end of the displacing movement.

During the raising of the carrier plate 39, the grip part 51 is pressed against the holding-down device 4 located above it and is now pivoted downward to the extent that the plate 46 reaches the open position shown in FIG. 10. In the course of the displacing movement of the carrier plate 39, with the plate 46 continuing to be held in the open position, the part of the flap P overlapping the pocket T is folded over by the folding bar 53 as shown in FIGS. 10 and 11. Since the folding bar 53 is now being moved past the seam N1 at a vertically spaced location from it, a larger folding radius is obtained than when the folder bar would move over the seam N1 at a closely spaced location from it. The consequence of this is that the folding over of the flap P is facilitated, especially when it consists, as, e.g., in the case of workwear garments or uniforms, of a comparatively stiff fabric. Near the end of the displacing movement, the sewing slot 43 is flush with the sewing slot 33 and the carrier plate 39 is therefore in the sewing position for the pocket seam N2. In the sewing position of the carrier plate 39 shown in FIG. 12, the grip part 51 is located outside the range of action of the holding-down device 4, so that the leaf spring 49 again pivots the plate 46 into the pressing position and holds it in that position.

After the carrier plate 39 has reached its sewing position, the pocket seam N2 is formed and the pocket T is thus sewn on the fabric part W. During all these process steps, i.e., even during the displacement of the carrier plate 39, the fabric holder 7 remains in its lowered position, in which the holding plate 32 continues to hold the fabric part W and the pocket T in a frictionally engaged manner and prevents any relative movement of the workpiece parts W, T and P in relation to the fabric holder 7 and in relation to one another. It is thus guaranteed also in the second exemplary embodiment that the flap P and the pocket T will be sewn on the fabric part W exactly in their original, mutually aligned positions.

Exemplary Embodiment 3

The fabric holder 70 shown in FIGS. 14 through 20 has a design that is essentially similar to that of the fabric holder 7 of the second exemplary embodiment. Therefore, it likewise has an essentially U-shaped frame 71 with a coupling strip 72, by means of which the fabric holder 70 can be coupled with the guide means 5.

A plane and especially flat holding plate 73 for the fabric part W and for the pocket T placed thereon is fastened on the underside of the frame 71. The holding plate 73 contains a sewing slot 74 for the passage of the needle 3 during the preparation of the essentially U-shaped pocket seam N1. A rectangular recess 75, which extends below the coupling strip 72, is provided in the holding plate 73 at a closely spaced location from the sewing slot 74.

Adjoining the holding plate 73, four small bearing blocks 76 are fastened on the frame 71. One guide groove 77 each, which is composed of a middle part 78 extending in parallel to the holding plate 73 and two obliquely extending end areas 79, is contained in the small bearing blocks 76.

Above the holding plate 73, the fabric holder 70 has a flat carrier plate 80, which has on its lateral edges 81 four small blocks 82 with one freely rotatable roller 83 each projecting over the lateral edge 81. The carrier plate 80 is mounted movably on the frame 71 by means of the rollers 83 engaging the corresponding guide grooves 77 of the small bearing blocks 76. On both sides of the carrier plate 80, one compressed air cylinder 84 each is mounted pivotably on the frame 71. The piston rods 85 are connected via ball-and-socket joints 86 to carrier pieces 87 fastened to the carrier plate 80.

For forming the pocket seam N1, the carrier plate 80 contains a sewing slot 88, which corresponds to the sewing slot 88 in the holding plate 73. A recess 89, which is used to receive the open edge K of the unfinished flap RP to be sewn on, is contained in the carrier plate 80 at a more widely spaced location from the sewing slot 88. The carrier plate 80 contains a crossbar 90, whose edge 91 limits the recess 89. The crossbar 90 has a sewing slot 92 for forming the second flap seam N3.

A spring plate 93, which has a spring strip 94, which passes through the sewing slot 92 and projects below the underside of the crossbar 90, is fastened to the crossbar 90.

A second, much narrower recess 95 in the carrier plate 80, which said recess extends between the legs of the sewing slot 88, opens into the recess 89. An essentially T-shaped plate 96, which is composed of a web part 97 and a pressing strip 98, is associated with the two recesses 89, 95. The plate 96 is held by a leaf spring 99, one half of the leaf spring 99 being fastened to the carrier plate 80 and the other half to the web part 97.

Figure 15:
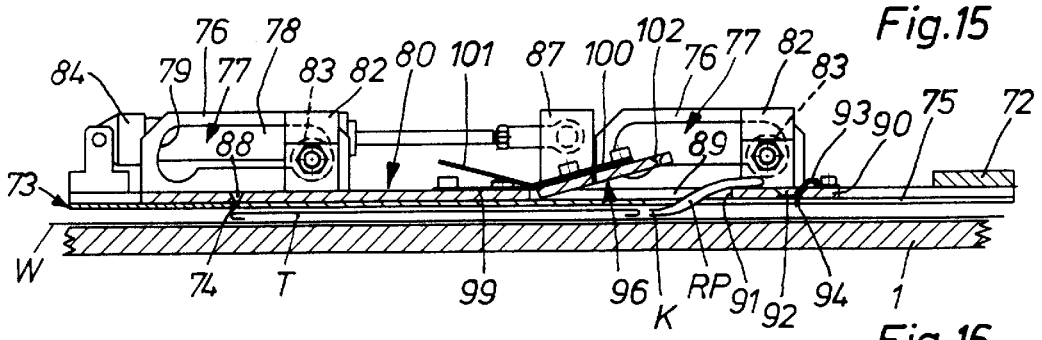
FIG. 15 is a sectional view of the fabric holder along line XV—XV in FIG. 14 after the insertion of a flap with the pressing strip in the open position.
Figure 16:
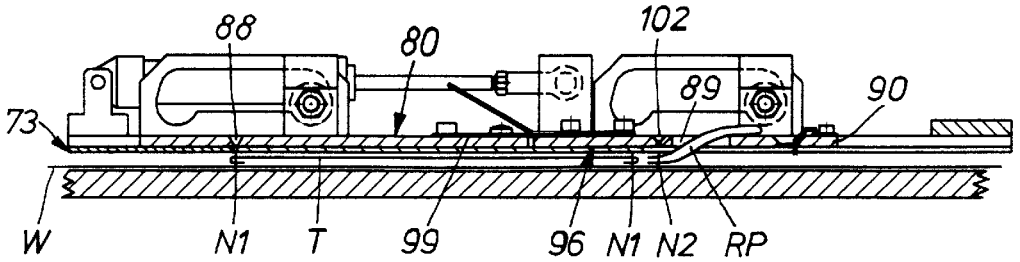
FIG. 16 is a sectional view corresponding to FIG. 15 after the flap has been sewn on and after the first flap seam has been formed.

The leaf spring 99 is used not only as a support for the plate 96, but additionally also as a joint, so that the plate 96 can be pivoted to and fro between an open position according to FIG. 15 and a pressing position according to FIG. 16. The leaf spring 99 is pretensioned such that is holds the plate 96 and the pressing strip 98 in the pressing position. A narrow angle plate 100, which has a grip part 101, is fastened to the leaf spring 99. The pressing strip 98 contains a sewing slot 102 for forming the first flap seam N2.

The Mode of Operation is as Follows

The fabric part W is spread out flat under the folding device 8 and aligned. As soon as the pocket T has been folded over and placed on the fabric part W, the guide means 5 moves the fabric holder 70 into the area of the folding device 8 and takes over the two workpiece parts W and T. The holding plate 73, which is provided with a sticky coating on its underside, now presses the fabric part W against the support plate 1. No later than at this point in time, the carrier plate 80 is moved by means of the two compressed air cylinders 84 into the position shown in FIGS. 14 through 16, in which the sewing slot 88 for the pocket seam N1 is flush with the sewing slot 74 in the holding plate 73.

The operator then pivots the plate 96 into its open position with one hand and places the open edge K of the flap RP with the other hand on the workpiece W through the recess 89 of the carrier plate 80 and the recess 75 of the holding plate 73. The majority of the flap RP now extends obliquely upwards at a flat angle and lies with the opposite edge on the crossbar 90. After releasing the grip part 101, the leaf spring 99 pivots the plate 96 back into the pressing position, as a result of which the edge area of the flap RP to be sewn on is pressed against the fabric part W. The fabric holder 70 is then transferred by the guide means 5 into the sewing position. Since the fabric part W and the pocket T are now being grasped by the holding plate 73 in a fictionally engaged manner, and the flap RP is being pressed by the pressing strip 98 against the fabric part W in a skidproof manner, the relative positions of the workpiece parts W, T and RP in relation to one another as well as in relation to the fabric holder 70 are secured.

With the holding-down device 4 raised, the fabric holder 70 is first moved with the overlapping sewing slots 74, 88 into the sewing position. As soon as this position has been reached, the holding-down device 4 is lowered onto the carrier plate 80 and the pocket seam N1 is formed as the first seam. With the holding plate 73 continuing to lie on the fabric part W and the pocket T, the first flap seam N2 is formed through the sewing slot 102 of the pressing strip 98 and the flap RP is thus fastened to the fabric part W.

Figure 14:
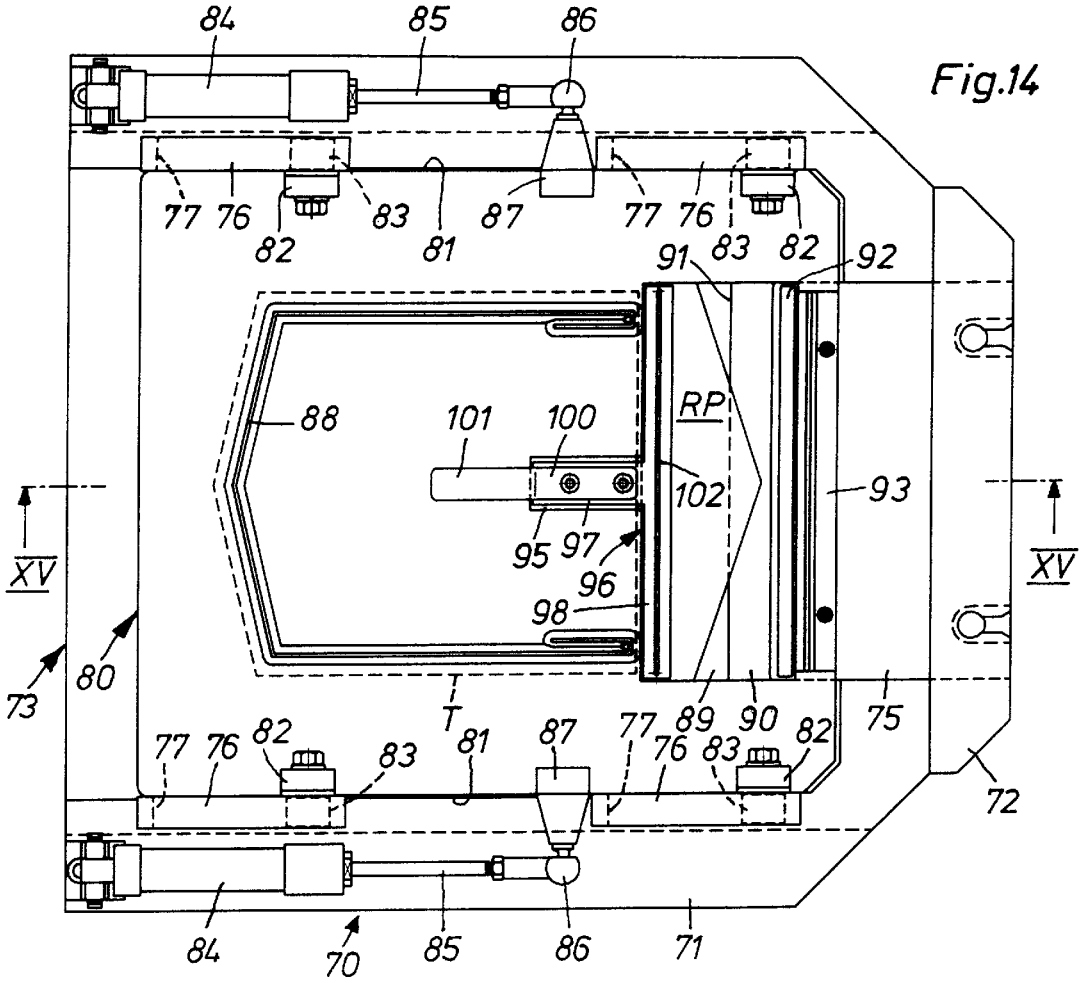
FIG. 14 is a top view of the fabric holder of the third exemplary embodiment after the insertion of an unfinished flap with the pressing strip for the flap in the clamping position.
Figure 18:
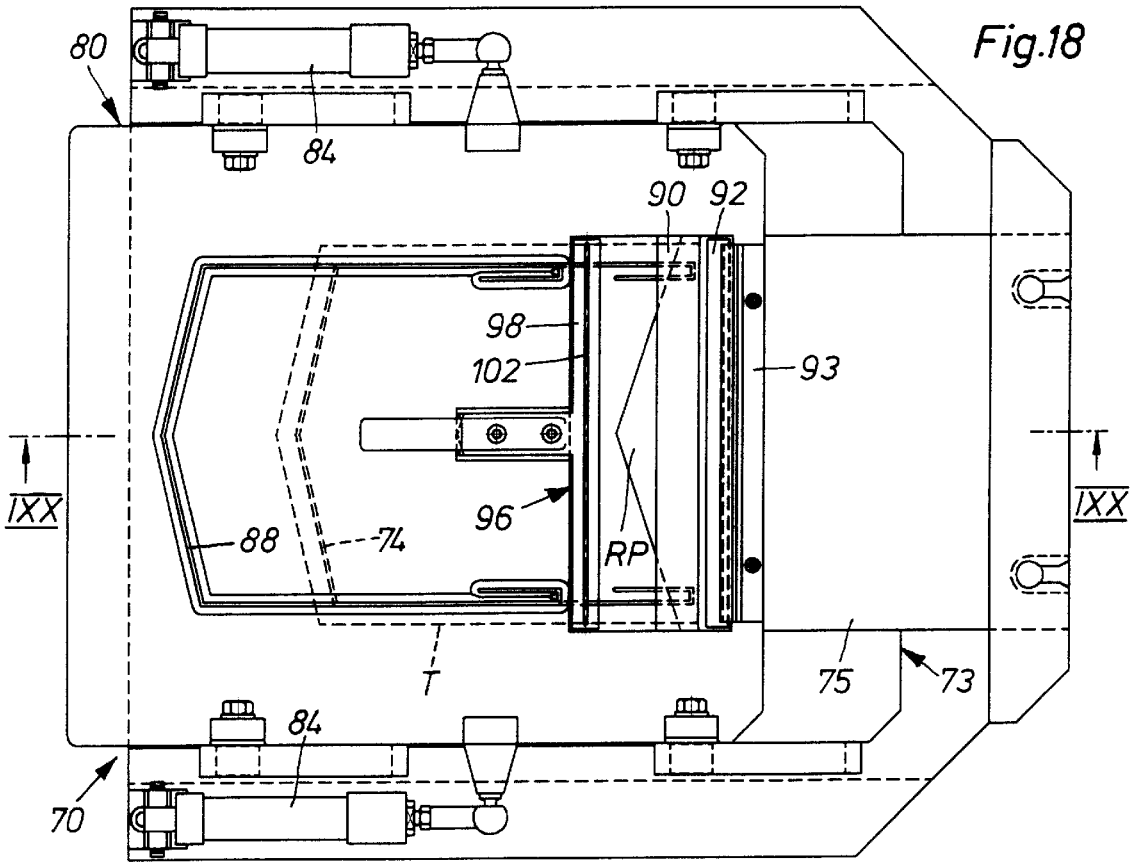
FIG. 18 is a top view of the fabric holder of the third exemplary embodiment after the second flap seam has been formed.
Figure 19:
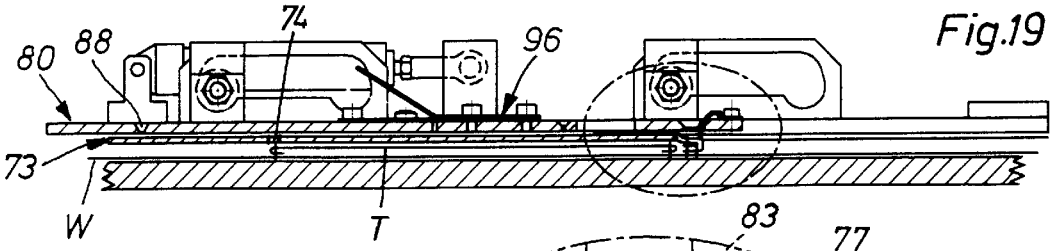
FIG. 19 is a sectional view of the fabric holder along line IXX—IXX in FIG. 18 after the second flap seam has been formed.

The holding-down device 4 is subsequently raised and the carrier plate 80 is displaced to the left in relation to the holding plate 73 from the sewing position shown in FIGS. 14 through 16 into the offset position shown in FIGS. 18 and 19 by admitting pressure to the two compressed air cylinders 84. This displacing movement is facilitated by the rollers 83 being pushed upwards in the right-hand, obliquely extending end area 79 of the guide grooves 77 at the beginning of the displacement, thereby lifting the carrier plate 80 off from the holding plate 73, as a consequence of which the carrier plate 80 has no contact with the holding plate 73 as long as the rollers 83 are moving within the middle part 78 of the guide grooves 77. The carrier plate 80 is again lowered onto the holding plate 73 only when the rollers 83 reach the left-hand, obliquely extending end area 79 of the guide grooves 77 near the end of the displacing movement.

Figure 17:
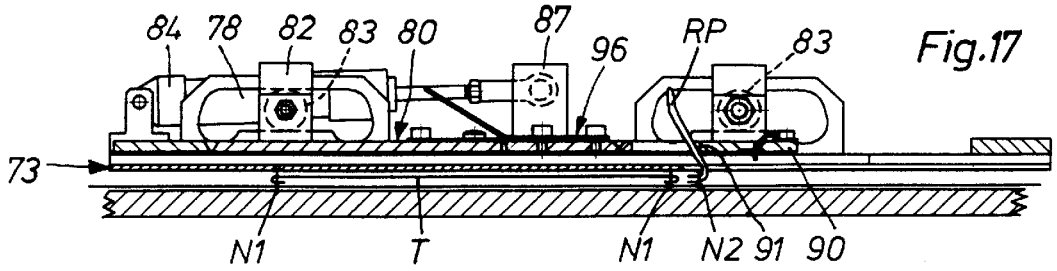
FIG. 17 is a sectional view corresponding to FIG. 15, which shows the situation in which the flap is folded over into its position of use.
Figure 20:
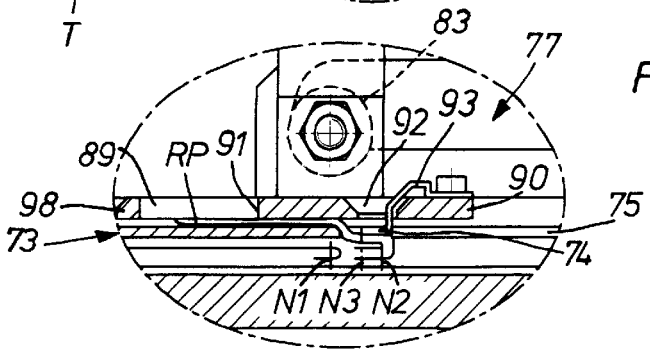
FIG. 20 is an enlarged detail from FIG. 19.

In the further course of the displacing movement of the carrier plate 80, with the plate 96 being continued to be held in the pressing position, the part of the flap RP, which extends to the right of the flap seam N2 according to FIG. 16, is folded over around the flap seam N2 into the later position of use by the edge 91 of the crossbar 90 moving from right to left, as is shown in FIG. 17. Since the crossbar 90 is now being moved past the seam N2 at a vertically spaced location, a larger folding radius will be obtained than when the crossbar 90 would be moving past just above the seam N2. The consequence of this is that the folding over of the flap RP is facilitated, especially when it consists, as, e.g., in the case of workwear garments or uniforms, of a comparatively stiff fabric. Near the end of the displacing movement, the spring strip 94 is lowered onto the folding edge of the folded-over flap RP and lies flat, as is shown in FIGS. 19 and 20. After the carrier plate 80 has reached its end position and is again resting on the holding plate 73, the second flap seam N3, by which the flap RP is fastened in its position of use on the fabric part W, is formed through the sewing slot 92, which is now in the sewing position. Since the originally open edge K is now covered by the flap RP and the second flap seam N3 is located at a closely spaced location from the edge K, not only is the edge K invisible, but it is also secured against fraying.

During all these process steps, i.e., even during the displacement of the carrier plate 80, the fabric holder 70 remains in its lowered position, in which the holding plate 73 always holds the fabric part W and the pocket T in a frictionally engaged manner and prevents any relative movement of the workpiece parts W, T and RP in relation to the fabric holder 70 and in relation to one another. It is thus guaranteed that the flap RP and the pocket T will be sewn on the fabric part W exactly in the original, mutually aligned positions.

Exemplary Embodiment 4

The fabric holder 110 shown in FIGS. 21 through 24 is extensively identical to the fabric holder 70 of the third exemplary embodiment. To simplify the description, reference will be made to the detailed description of the third exemplary embodiment in the case of identical components, using the same reference numbers.

The fabric holder 110 correspondingly also has a frame 71. A holding plate 73, which contains a sewing slot 74 for the pocket seam N1 and a recess 75, is fastened to the underside of the said frame.

A carrier plate 80, which can be displaced in relation to the holding plate 73 by means of two compressed air cylinders 84 and has a sewing slot 88 for the pocket seam N1, is arranged above the holding plate 73. The carrier plate 80 contains a recess 89, which is used to receive the open edge K of the unfinished flap RP to be sewn on. The carrier plate 80 also contains a crossbar 90, which has a sewing slot 92 for the second flap seam N3 and carries a spring plate 93 with a spring strip 94.

The fabric holder 110 is identical to the fabric holder 70 up to this point. The differences will be described below.

An elongated recess 111 each arranged to the side of the two legs of the sewing slot 88 opens into the recess 89. One leaf spring 112 each is arranged in the area of these two recesses 111, one leg 113 being fastened to the holding plate 73 via a thin spacer plate 114. The other leg 115 of the leaf spring 112 is fastened to the underside of a flat projection 116, which is part of a lever 117 shaped in the form of an obtuse angle. The ends of the two levers 177 pointing away from the fabric holder 110 are connected to one another by a grip strip 118.

A compressed air cylinder 119 is fastened to the other end of each lever 117. One holding piece 121 each is arranged at the piston rods 120. The two holding pieces 121 carry together a flat pressing strip 122, which has, similarly to the pressing strip 98 of the third exemplary embodiment, a sewing slot 123 for forming the first flap seam N2. The lateral surface 124 of the pressing strip 122, which faces the compressed air cylinder 119 and extends at right angles to the direction of displacement of the carrier plate 80, is beveled by about 45°, as can be recognized from FIGS. 22 and 23. The lateral surface 125 of the holding plate 73, which is located directly opposite and forms a limitation of the recess 75, is likewise beveled, being so in a corresponding manner thereto, i.e., the two lateral surfaces 124, 125 extend in parallel to one another when the pressing strip 122 is in the position shown in FIGS. 23 and 24.

The Mode of Operation is as Follows

The fabric part W is spread out flat under the folding device 8 and aligned. As soon as the pocket T has been folded over and placed on the fabric part W, the guide means 5 moves the fabric holder 110 into the area of the folding device 8 and takes over the two workpiece parts W and T. The holding plate 73, which is provided with a sticky coating on its underside, now presses the fabric part W against the support plate 1. No later than at this point in time, the carrier plate 80 is moved by means of the two compressed air cylinders 84 into the position shown in FIGS. 21 through 23, in which the sewing slot 88 for the pocket seam N1 is flush with the sewing slot 74 in the holding plate 73.

The operator then actuates the grip strip 118 with one hand, thereby pivoting the pressing strip 122 into its open position, and places with the other hand the open edge K of the flap RP on the workpiece W through the recess 89 of the carrier plate 80 and the recess 75 of the holding plate 73. The majority of the flap RP now extends obliquely upwards at a flat angle and lies with the opposite edge on the crossbar 90. After releasing the grip strip 118, the leaf spring 112 pivots the pressing strip 122 into the pressing position, as a result of which the edge area of the flap RP to be sewn on is pressed against the fabric part W. The fabric holder 110 is then transferred by the guide means 5 into the sewing position. Since the fabric part W and the pocket T are now being grasped by the holding plate 73 in a frictionally engaged manner and the flap RP is being pressed by the pressing plate 112 against the fabric part W in a skidproof manner, the relative positions of the workpieces W, T and RP in relation to one another as well as in relation to the fabric holder 110 are secured.

With the holding-down device 4 raised, the fabric holder 110 is first moved with the overlapping sewing slots 74, 88 into the sewing position. As soon as this position has been reached, the holding-down device 4 is lowered onto the carrier plate 80 and the pocket seam N1 is formed as the first seam. With the holding plate 73 continuing to lie on the fabric part W and the pocket T, the first flap seam N2 is then formed through the sewing slot 123 of the pressing strip 122 and the flap RP is thus fastened to the fabric part W.

Figure 21:
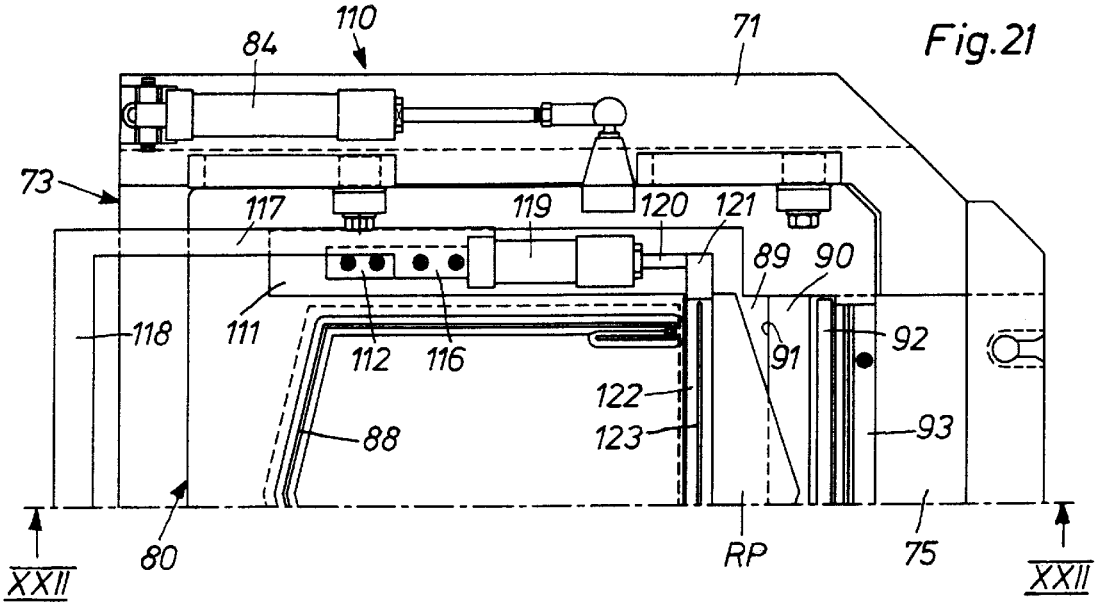
FIG. 21 is a top view of the fabric holder of the fourth exemplary embodiment after the insertion of an unfinished flap with the pressing strip for the flap in the closed, position.
Figure 22:
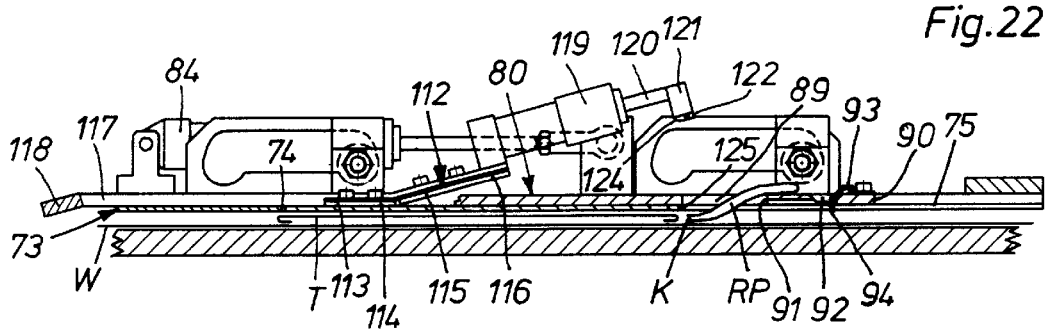
FIG. 22 is a sectional view of the fabric holder along line XXII—XXII in FIG. 21 after the insertion of a flap with the pressing strip in the open position.

The holding-down device 4 is subsequently raised and the carrier plate 80 is displaced to the left in relation to the holding plate 73 from the sewing position shown in FIGS. 21 through 23 into the offset position by admitting pressure to the two compressed air cylinders 84. This displacing movement takes place in the same manner as in the third exemplary embodiment.

Figure 23:
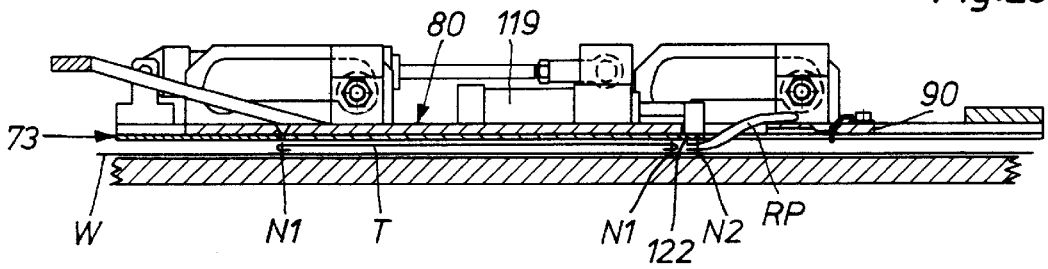
FIG. 23 is a sectional view corresponding to FIG. 22 after the pocket has been sewn on and after the first flap seam has been formed.
Figure 24:
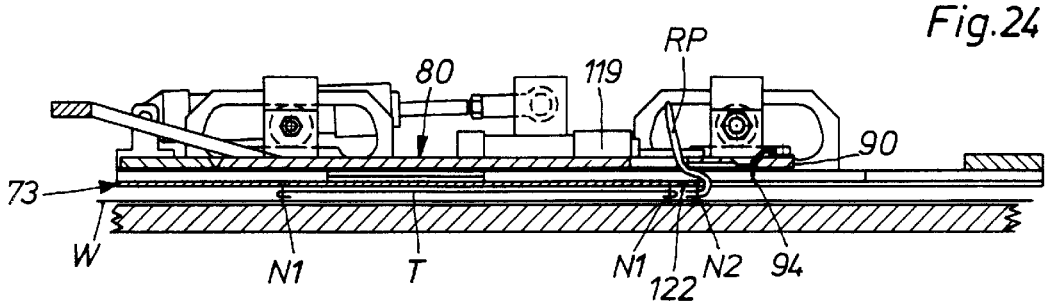
FIG. 24 is a sectional view corresponding to FIG. 22, which shows the situation in which the flap is folded into its position of use.

During the further course of the displacing movement of the carrier plate 80, with the pressing strip 122 being continued to be held in the pressing position, the part of the flap RP extending to the right of the flap seam N2 according to FIG. 23 is folded over around the pressing strip 122 into the later position of use by the edge 91 of the crossbar 90 moving from right to left, as is shown in FIG. 24. Since the crossbar 90 is now being moved past the pressing strip 122 at a vertically spaced location, a larger folding radius will be obtained than if the crossbar 90 were moving past just above the pressing strip 122. The consequence of this is that the folding over of the flap RP is facilitated, especially when it consists, as, e.g., in the case of workwear garments or uniforms, of a comparatively stiff fabric. Near the end of the displacing movement, the spring strip 94 is lowered onto the folding edge of the folded-over flap RP and it presses same against the pressing strip 122. After the carrier plate 80 has reached its end position and is again resting on the holding plate 73, pressure is admitted to the two compressed air cylinders 119, which will then move the pressing strip 122 to the left. The oblique lateral surface 124 of the pressing strip 122 is now sliding past the oblique lateral surface 125 of the holding plate 73, as a result of which the pressing strip 122 is raised onto the holding plate 73. The pressing strip 122 is subsequently moved along on the holding plate 73 and thus in the area of the recess 89, which has likewise been displaced to the left due to the displacement of the carrier plate 80, to the extent that it is completely removed from the area of the crossbar 90 and from the recess 75 of the holding plate 73. The pressing strip 122 is thus also pulled out of the folding zone of the flap RP formed in the area of the first flap seam N2, after which the spring strip 94 flatly compresses the folding edge of the folded-over flap RP.

The second flap seam N3, by which the flap RP is fastened on the fabric part W in its position of use, is then formed through the sewing slot 92, which is now in the sewing position. Since the originally open edge K is now covered by the flap RP and the second flap seam N3 is located at a closely spaced location from the edge K, not only is the edge K invisible, but it is also secured against fraying.

During all these process steps, i.e., even during the displacement of the carrier plate 80, the fabric holder 110 remains in its lowered position, in which the holding plate 73 always holds the fabric part W and the pocket T in a frictionally engaged manner and prevents any relative movement of the workpiece parts W, T and RP in relation to the fabric holder 110 and in relation to one another. It is thus guaranteed that the flap RP and the pocket T will be sewn on the fabric part W exactly in the original, mutually aligned positions.

While specific embodiments of the invention have been shown and described in detail to illustrate the application of the principles of the invention, it will be understood that the invention may be embodied otherwise without departing from such principles.

What is claimed is:

1. A process for sewing a presewn flap and a pocket partially covered by same on a fabric part by using a sewing unit, with a sewing machine and a guide means having a fabric holder, the process comprising the steps of:

folding the pocket over in an edge area and grasping the folded pocket and the fabric part by the fabric holder in a frictionally engaged manner, the frictionally engaged grasping being maintained uninterruptedly in subsequent process steps;

positioning the flap in the fabric holder in a later position of use;

feeding the fabric part, the pocket and the flap by the guide means to the sewing machine;

connecting the flap to the fabric part by a seam;

removing the part of the flap overlapping the pocket from the area of the pocket; and connecting the pocket to the fabric part by a another seam.

2. A sewing unit for sewing a presewn flap and a pocket partially covered by same on a fabric part by folding the pocket over in an edge area and grasping the folded pocket and the fabric part by the fabric holder and fixing the folded pocket and the fabric part uninterruptedly in relation to one another during the subsequent operations, positioning the flap in the fabric holder in a later position of use, feeding the fabric part, the pocket and the flap by the guide means to the sewing machine, connecting the flap to the fabric part by a seam, removing the part of the flap overlapping the pocket from the area of the pocket, and connecting the pocket to the fabric part by another seam, the sewing unit comprising:

a sewing machine;

a fabric support plate;

a folding device for folding the pocket arranged above said fabric support plate;

a fabric holder with a holding plate for said pocket placed on the fabric part, wherein said holding plate has an opening for receiving at least the edge area of the flap to be sewn on as well as a pocket seam sewing slot;

a drive means;

a pivotably mounted pressing plate for at least the edge area of the flap to be sewn on and with at least one folding element displaceable by said drive means for engaging the part of the said flap overlapping the pocket; and a guide means for moving said fabric holder from said folding device to said sewing machine and for performing a relative movement between said fabric holder and said sewing machine during the sewing on of the flap and of said pocket.

3. The sewing unit in accordance with claim 2, wherein a pressing plate for the flap is arranged on said holding plate for said pocket and two flat fingers are provided as said folding device, said flat fingers being connected to a piston rod of a separate pressurized medium cylinder fastened on said holding plate.

4. The sewing unit in accordance with claim 2, further comprising:

a carrier plate which is displaceable in the horizontal plane in parallel to the center line of the pocket and has said sewing slot for the another seam and, at a greater distance from said sewing slot an opening for receiving the flap, said carrier plate being arranged above said holding plate of a flat design for the pocket, said pressing plate for the flap being arranged on said carrier plate;

a folding bar extending at right angles in an area of an opening is arranged at the said carrier plate; and two pressurized medium cylinders for moving said carrier plate into two different positions, wherein said sewing slot for said flap seam provided in said pressing plate is located above the edge area of said flap to be sewn on and said pocket seam sewing slot of said carrier plate is offset in relation to said pocket seam sewing slot of said holding plate in one of these positions, while said sewing slot of said pressing plate is offset in relation to the edge area of the said flap now sewn on in the other position, whereas said sewing slot of said carrier plate is aligned with said pocket seam sewing slot of said holding plate.

5. A process for sewing an unfinished flap and a pocket partially covered by same on a fabric part using a sewing unit with a fabric support plate, a sewing machine and a guide means having a fabric holder, the process comprising the steps of:

folding the pocket over in an edge area and grasping the pocket and the fabric part by the fabric holder in cooperation with the fabric support plate in a frictionally engaged manner, wherein the frictionally engaged holding is maintained uninterruptedly during subsequent process steps;

positioning the flap in the fabric holder in an aligned position rotated by 180° in relation to the finished position of use;

feeding the fabric part, the pocket and the flap by the guide means to the sewing machine;

connecting the pocket to the fabric part by a seam;

connecting the flap to the fabric part by a flap connecting seam; and folding the flap over around the flap connecting seam into the position of use and connecting the fabric part by another seam.

6. A sewing device, comprising:

a fabric support plate;

a sewing machine arranged on said fabric support plate;

a folding device for a pocket, said folding device being arranged above said fabric support plate;

a fabric holder;

a guide means, said fabric holder being connected to said guide means for moving said fabric holder from said folding device to said sewing machine and to perform a relative movement between said fabric holder and said sewing machine during a sewing on of the pocket and of a flap;

a fabric holder with a holding plate, said holding plate for holding the pocket placed on a fabric part, wherein said holding plate has a recess for receiving an unfinished closing edge of the flap as well as a sewing slot for a pocket seam;

a carrier plate extending in parallel to a plane of said holding plate, said carrier plate being displaceable in parallel to a center line of the pocket, said carrier plate having a sewing slot for the pocket seam as well as a recess for receiving said flap arranged on said holding plate;

a pressing strip, pivotable into said recess for the flap and having a sewing slot for a first flap seam, arranged on said carrier plate;

a crossbar provided in said carrier plate, said crossbar having a front edge limiting said recess for said flap as well as a sewing slot for a second flap seam, said carrier plate being movable into two different positions, wherein the sewing slot for the first flap seam, which is contained in said pressing strip, is located above an open closing edge of the flap in one position, the sewing slot for the pocket seam is flush with the corresponding sewing slot of said holding plate and said front edge of said crossbar is located under said flap, while in the other position said sewing slot contained in said crossbar is in a sewing position for the second flap seam, said sewing slot for the pocket flap, which has meanwhile been prepared, is offset in relation to said corresponding sewing slot of said holding plate and said front edge of said crossbar is located above said flap folded over into a final position of use due to the displacement of said carrier plate.

7. A sewing device, comprising:

a fabric support plate;

a sewing machine arranged on said fabric support plate;

a folding device for a pocket, said folding device being arranged above said fabric support plate;

a fabric holder;

a guide means, said fabric holder being connected to a said guide means for moving said fabric holder from said folding device to said sewing machine and to perform a relative movement between said fabric holder and said sewing machine during a sewing on of the pocket and of a flap;

a fabric holder with a holding plate, said holding plate for holding the pocket placed on a fabric part, wherein said holding plate has a recess for receiving an unfinished closing edge of the flap as well as a sewing slot for a pocket seam;

a carrier plate extending in parallel to a plane of said holding plate, said carrier plate being displaceable in parallel to a center line of the pocket, said carrier plate having a sewing slot for the pocket seam as well as a recess for receiving said flap arranged on said holding plate;

a pivotably movable holding device passing through a corresponding recess in said carrier plate and carrying a pressurized medium cylinder with a piston rod, said movable holding device being provided on said holding plate on both sides of a sewing slot for a pocket seam;

a pressing strip arranged at said piston rods of said cylinders, said pressing strip being pivotable into said recess for the flap, said pressing strip having a sewing slot for a first flap seam and in which a lateral surface located adjacent to said holding plate is beveled, said carrier plate having a crossbar which has a front edge limiting said recess for the flap as well as a sewing slot for a second flap seam and said carrier plate being movable into two different positions including a first position in which said sewing slot for the pocket seam is flush with the corresponding sewing slot of said holding plate and the front edge of said crossbar is located under the flap and a second position in which said pressing strip remains in its pressing position and said sewing slot contained in said crossbar is located in the sewing position for said second flap seam, said sewing slot for the pocket seam, which has meanwhile been prepared, is offset in relation to said corresponding sewing slot of said holding plate, and said front edge of said crossbar is located above said flap folded over into its final position of use due to the displacement of said carrier plate, and said pressing strip can be pulled out under said crossbar after said carrier plate has been moved into its second position by said cylinders.

8. The sewing unit in accordance with claim 6, further comprising a holding-down device formed by a spring strip, which passes through said sewing slot for the second flap seam and projects under an underside of said crossbar, said holding-down device being fastened to said crossbar.

9. The sewing unit in accordance with claim 7, further comprising a holding-down device formed by a spring strip, which passes through said sewing slot for the second flap seam and projects under an underside of said crossbar, said holding-down device being fastened to said crossbar.

10. The sewing unit in accordance with claim 4, wherein:

said holding plate is fastened to a frame;

said carrier plate is accommodated in guide grooves of corresponding small bearing blocks fastened to said frame by means of four rollers which are arranged in an area of corners of said carrier plate and laterally project over an edge of said carrier plate; and compressed medium cylinders are supported on said frame.

11. The sewing unit in accordance with claim 6, wherein:

said holding plate is fastened to a frame;

said carrier plate is accommodated in guide grooves of corresponding small bearing blocks fastened to said frame by means of four rollers which are arranged in an area of corners of said carrier plate and laterally project over an edge of said carrier plate; and compressed medium cylinders are supported on said frame.

12. The sewing unit in accordance with claim 7, wherein:

said holding plate is fastened to a frame;

said carrier plate is accommodated in guide grooves of corresponding small bearing blocks fastened to said frame by means of four rollers which are arranged in an area of corners of said carrier plate and laterally project over an edge of said carrier plate; and compressed medium cylinders are supported on said frame.

13. The sewing unit in accordance with claim 8, wherein:

said holding plate is fastened to a frame;

said carrier plate is accommodated in guide grooves of corresponding small bearing blocks fastened to said frame by means of four rollers which are arranged in an area of corners of said carrier plate and laterally project over an edge of said carrier plate; and compressed medium cylinders are supported on said frame.

14. A sewing unit in accordance with claim 10, wherein said guide grooves of said small bearing blocks have end areas extending obliquely downwards.

15. A sewing unit in accordance with claim 11, wherein said guide grooves of said small bearing blocks have end areas extending obliquely downwards.

16. A sewing unit in accordance with claim 12, wherein said guide grooves of said small bearing blocks have end areas extending obliquely downwards.

* * * * *